US005996926A

United States Patent [19]

Dropczynski

[11] Patent Number: 5,996,926

[45] Date of Patent: Dec. 7, 1999

[54] WINDING APPARATUS WITH AIR-CUSHION ROLL SUPPORT

[75] Inventor: Hartmut Dropczynski, Dormagen, Germany

[73] Assignee: Jagenberg Papiertechnik GmbH, Neuss, Germany

[21] Appl. No.: 09/036,212

[22] Filed: Mar. 6, 1998

[30] Foreign Application Priority Data

Mar. 7, 1997 [DE] Germany ..... 197 09 325

[51] Int. Cl.[6] ..... B65H 18/14

[52] U.S. Cl. ..... 242/541.7; 242/541.4; 242/542

[58] Field of Search ..... 242/541.7, 541.4, 242/542, 542.4

[56] References Cited

U.S. PATENT DOCUMENTS

| | | | |
|---|---|---|---|
| 3,497,151 | 2/1970 | Voss et al. | 242/541.7 |
| 5,478,026 | 12/1995 | Schonmeier et al. | 242/542 X |
| 5,492,287 | 2/1996 | Raudaskoski et al. | 242/541.4 |
| 5,499,779 | 3/1996 | Raudaskoski | 242/541.4 |
| 5,562,261 | 10/1996 | Beisswanger et al. | 242/541.7 X |
| 5,673,870 | 10/1997 | Fielding et al. | 242/541.7 X |
| 5,820,063 | 10/1998 | Fissman et al. | 242/541.7 X |
| 5,829,709 | 11/1998 | Dorfel | 242/542 |
| 5,839,689 | 11/1998 | Kruger et al. | 242/542 |
| 5,855,337 | 1/1999 | Schonmeier et al. | 242/541.7 |

FOREIGN PATENT DOCUMENTS

| | | | |
|---|---|---|---|
| 0 631 956 | 1/1995 | European Pat. Off. . | |
| 0 631 956 A2 | 1/1995 | European Pat. Off. . | |
| 0 665 178 A2 | 8/1995 | European Pat. Off. . | |
| 1 047 001 | 9/1957 | Germany . | |
| 1047001 | 12/1958 | Germany | 242/541.7 |
| 1 111 496 | 4/1960 | Germany . | |
| 94 14 449 U1 | 2/1996 | Germany . | |
| WO 92/03366 | 3/1992 | WIPO . | |

*Primary Examiner*—Donald P. Walsh
*Assistant Examiner*—Minh-Chau Pham
*Attorney, Agent, or Firm*—Herbert Dubno

[57] ABSTRACT

An apparatus for winding a web onto a roll has a pair of support rollers extending along respective substantially parallel horizontal axes and defining an upwardly open cradle holding the roll, a bottom plate extending axially underneath the rollers, and respective axially extending side plates extending upward from the bottom plate and engaging the rollers. The rollers, rolls, bottom plate, and side plates together form an axially extending and laterally closed space. A pair of axially spaced end plates lying in respective upright planes and closing ends of the space are each shaped to fit between the rollers and between the side plates and each can slide axially along the bottom and floor plates between an outer position spaced axially from the rollers and roll and an inner position between the rollers and engaging a respective axial end of the roll. The space between the end plates can be pressurized with air. A drive displaces the end plates between their positions.

6 Claims, 4 Drawing Sheets

WINDING APPARATUS WITH AIR-CUSHION ROLL SUPPORT

SPECIFICATION

1. Field of the Invention

The present invention relates to a winding or reeling apparatus for winding up a continuous web on a roll. More particularly this invention concerns such an apparatus where an air cushion is formed beneath the roll being wound to at least partially support it.

2. Background of the Invention

In order to form rolls of paper or cardboard, a very wide continuous web is normally fed through a slitter that cuts it longitudinally into a plurality of strips that are passed around a common horizontal first support roller and then engaged with respective rolls carried on respective sleeves. The rolls are supported by the first support roller around which the web strips pass and by a second such support roller extending horizontally next to it and forming an upwardly open cradle in which the rolls being wound rest. The two support rollers are driven to rotate the rolls and wind up the web strips thereon.

The hardness and size of each roll depend largely on the tension applied to the respective strip and also on the so-called line pressure which is the force with which the rolls bear on the support rollers. If this force is increased the roll is tight and hard and vice versa. In fact it is known to provide special pressure rollers that push the rolls being wound down against the support rollers at the start of the winding operation when the weight of the rolls is not in itself enough to achieve the desired hardness.

Once the rolls have reached a certain diameter, normally about 1 meter, their weight can be so great that the line pressure is excessive. Accordingly it is known from PCT publication WO 92/03366 of H. Thul and European patent application 0,631,956 of V. Raudaskoski to close off the generally triangular-section space defined between the support rollers and the rolls being wound and to pressurize this space with air to, in effect, lift the rolls being formed on an air cushion. In this manner immense rolls can be formed without winding them too hard in at least the last stages of winding.

These known pressurizing systems are fairly complex, entailing elaborate shields that are closely juxtaposed with the various rollers and rolls as well as complicated seal structures. This equipment is a considerable hindrance when trying to take the finished rolls out of the machine and when loading new core sleeves into it. Furthermore these systems only work when the rolls being made up take up substantially the entire length of the support rollers, as the various seals and shields for the axial ends of the space to be pressurized are mounted at the ends of the support rolls.

OBJECTS OF THE INVENTION

It is therefore an object of the present invention to provide an improved winding machine with air-cushion support for the roll being wound.

Another object is the provision of such an improved winding machine with air-cushion support for the roll or rolls being wound which overcomes the above-given disadvantages, that is which is simple in construction, which seals well, and which can even be used to wind up a single very short roll on two long support rollers.

SUMMARY OF THE INVENTION

An apparatus for winding a web onto a roll has according to the invention a pair of support rollers extending along respective substantially parallel horizontal axes and defining an upwardly open cradle holding the roll, a bottom plate extending axially underneath the rollers, and respective axially extending side plates extending upward from the bottom plate and engaging the rollers. The rollers, rolls, bottom plate, and side plates together form an axially extending and laterally closed space. A pair of axially spaced end plates lying in respective upright planes and closing ends of the space are each shaped to fit between the rollers and between the side plates and each can slide axially along the bottom and floor plates between an outer position spaced axially from the rollers and roll and an inner position between the rollers and engaging a respective axial end of the roll. The space between the end plates can be pressurized with air. A drive displaces the end plates between their positions.

Thus with this system the end plates can be moved into any position, if necessary to flank a short single roll in the middle of the machine. On the other hand they can be backed off to free the critical end space of the support rollers, making it fairly simple to load in new cores and take out finished rolls.

In accordance with the invention the bottom plate is provided with guides on which the end plates ride. In addition this bottom plate has axially extending outer edges provided with hinges carrying the respective side plates.

The drive according to the invention includes an axially extending threaded spindle, a motor for rotating the spindle, and a nut on each plate threaded on the spindle. In their outer positions the end plates are axially offset outward from ends of the rollers. It is also possible for the end plates to be each formed of a pair of sections and a hinge level with the axes and interconnecting the sections.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
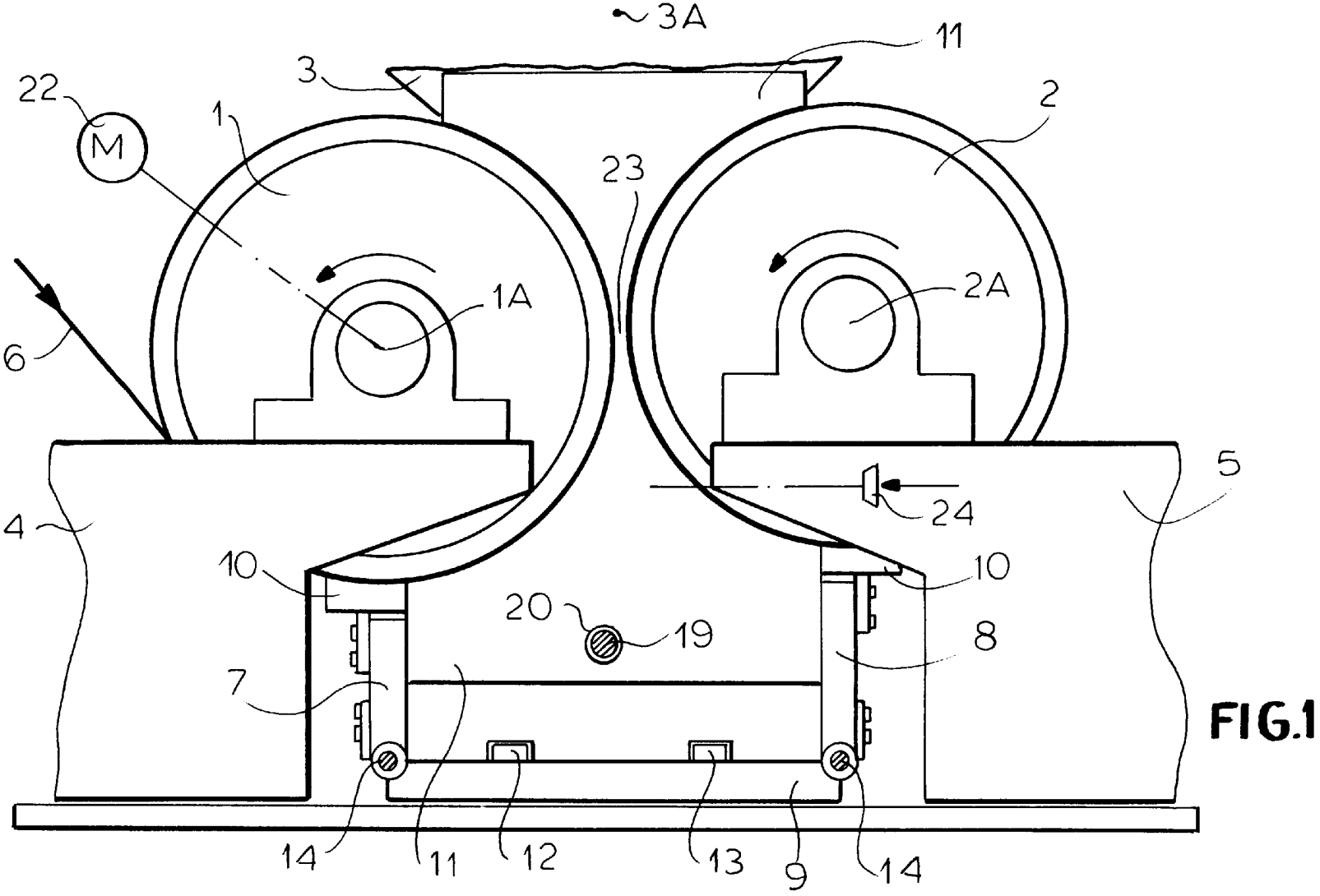
FIG. 1 is a partly diagrammatic end view of the apparatus according to the invention.
Figure 2:
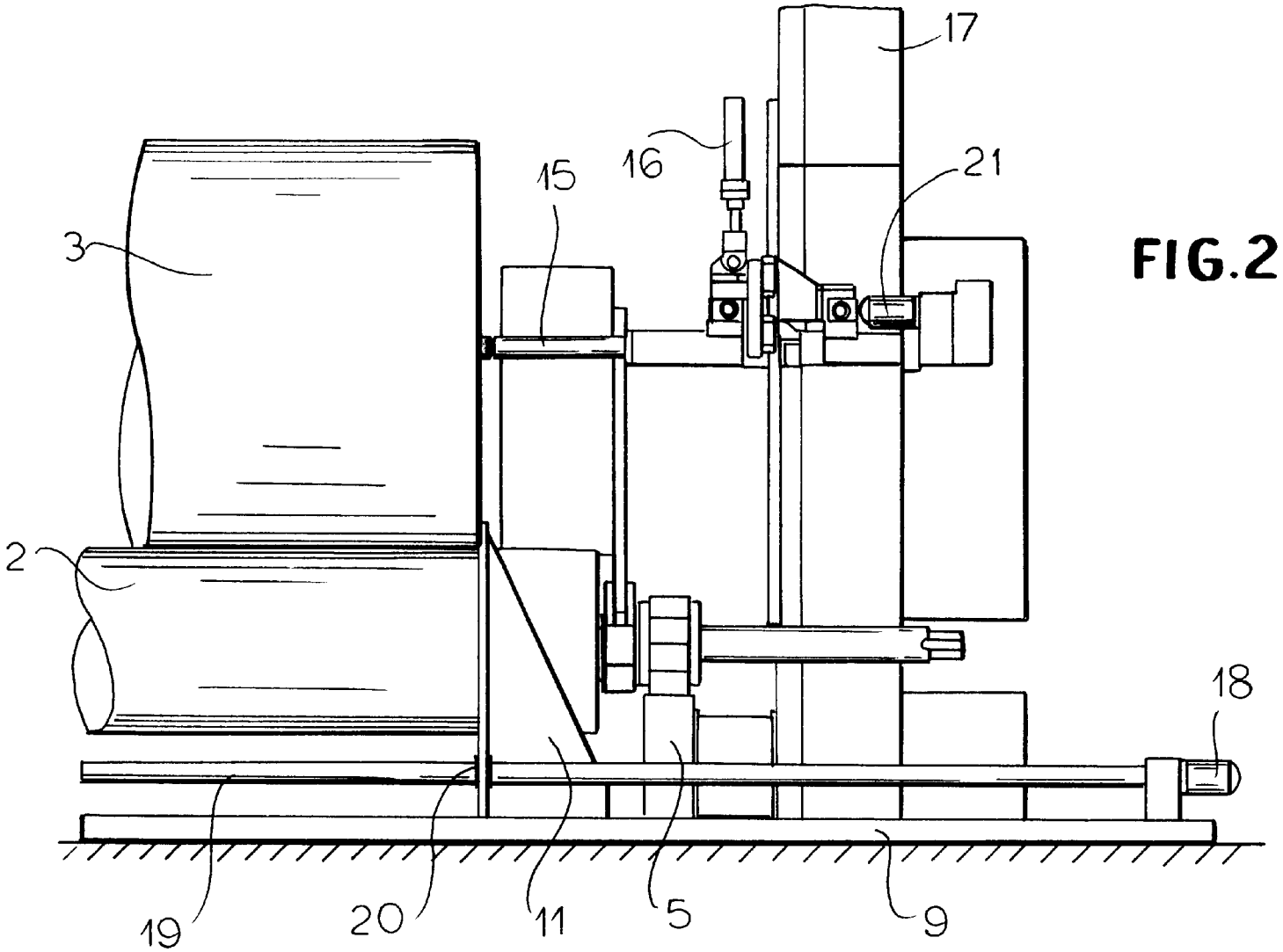
FIGS. 2 and 3 are side views of the an end of the equipment with the respective end shield in place on a nearly finished roll and with the end shield retracted for loading in a new core sleeve.

As seen in FIGS. 1 and 2 a pair of large-diameter cylindrical support rollers 1 and 2 are held on respective cantilevered supports 4 and 5 for rotation about respective axes 1A and 2A that are horizontal and parallel. A motor illustrated schematically at 22 is connected to one or both of the rollers 1 and 2 to rotate them in the same direction as indicated by arrows. One or more rolls 3 centered on an axis 3A parallel to the axes 1A and 2A are supported on the upwardly open cradle formed by the two rollers 1 and 2. A single wide web pulled from an unillustrated supply is slit into a plurality of parallel strips 6 that are passed down and around the roller 1 and then wound up on respective cores to form the rolls 3. This structure is all generally standard.

According to the invention a shield structure forms between the rollers 1 and underneath the rolls 3 a substantially closed space or chamber 23 that can be pressurized with air from a source indicated schematically at 24 to reduce the line pressure where the rolls 3 bear on the rollers 1 and 2. This shield structure comprises as shown in FIG. 2 a horizontal bottom plate or base member 9, a pair of normally vertical side members or plates 7 and 8 mounted by hinges 14 at outer edges parallel to the axes 1A and 2A of the plate 9 and having upper ends provided with elongated shoe bars 10 engaging the respective rollers 1 and 2, and a pair of identical and planar upright end plates 11 of which one is shown. The end plates 11 are each basically I-shaped, with a pair of oppositely directed semicircular side cutouts that fit complementarily with the outer surfaces of the rollers 1 and 2 and a square upper edge that extends well up so each plate 11 can lie flat against the respective axial end of the roll(s) 3. The plates 7, 8, and/or 9 are formed with passages having outer ends connected to the blower 24 and inner ends that open near the center of the machine into the space 23.

The plates 11 stand in vertical planes perpendicular to the axes 1A and 2A and ride on rails 12 and 13 extending parallel to these axes 1A and 2A on the base plate 9. A spindle 19 extending parallel to the axes 1A and 2A is threaded into a nut 20 of each plate 11 and is rotatable by a motor 18 (FIG. 2) so that each plate 11 can be moved axially from an inner position engaging the other plate 11 to an outer position shown in FIG. 2. If two spindles 19 are used the plates 11 can be moved independently, if one is used with two sections that have opposite threads the plates 11 can be moved synchronously and complementarily.

Figure 3:
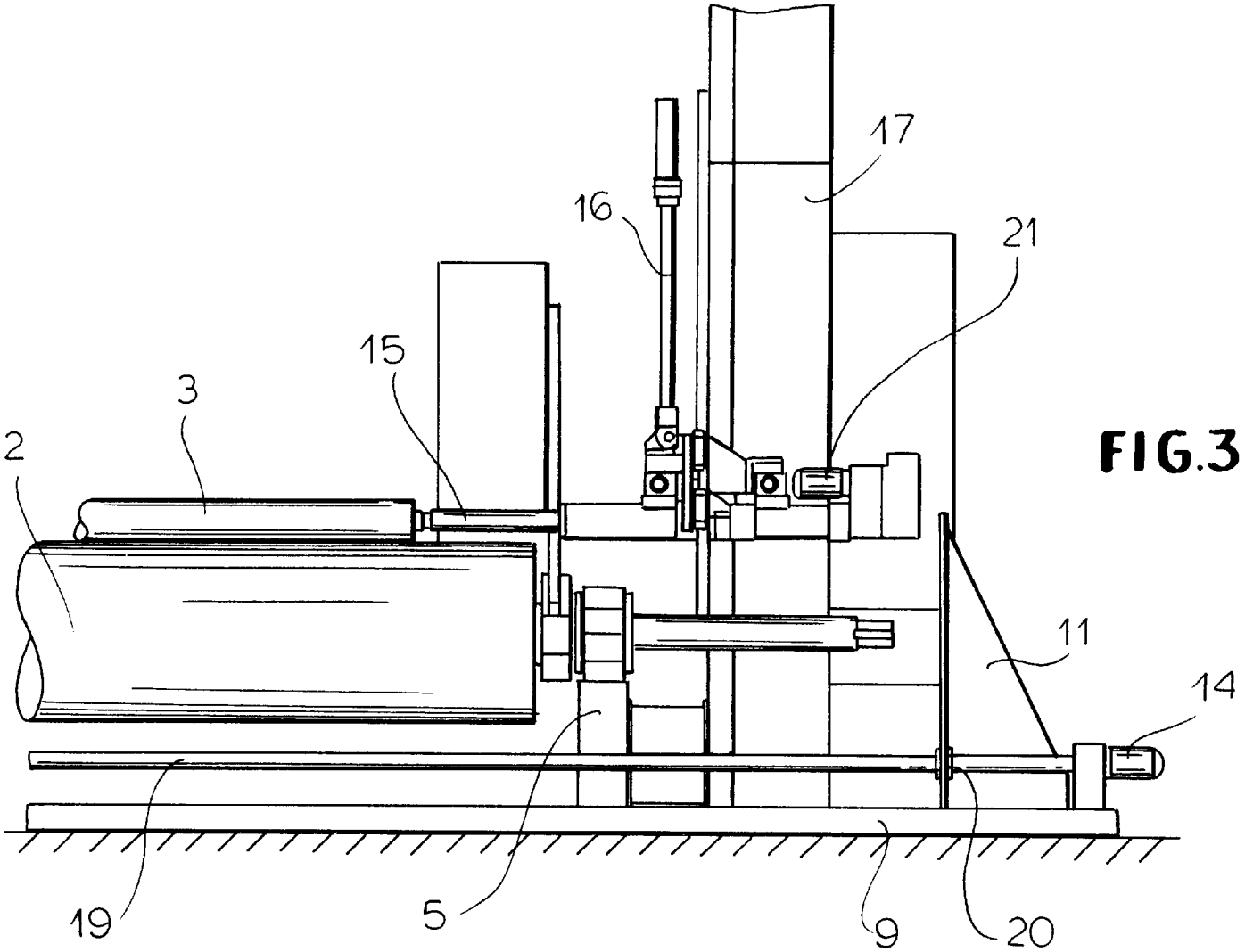
Figure 4:
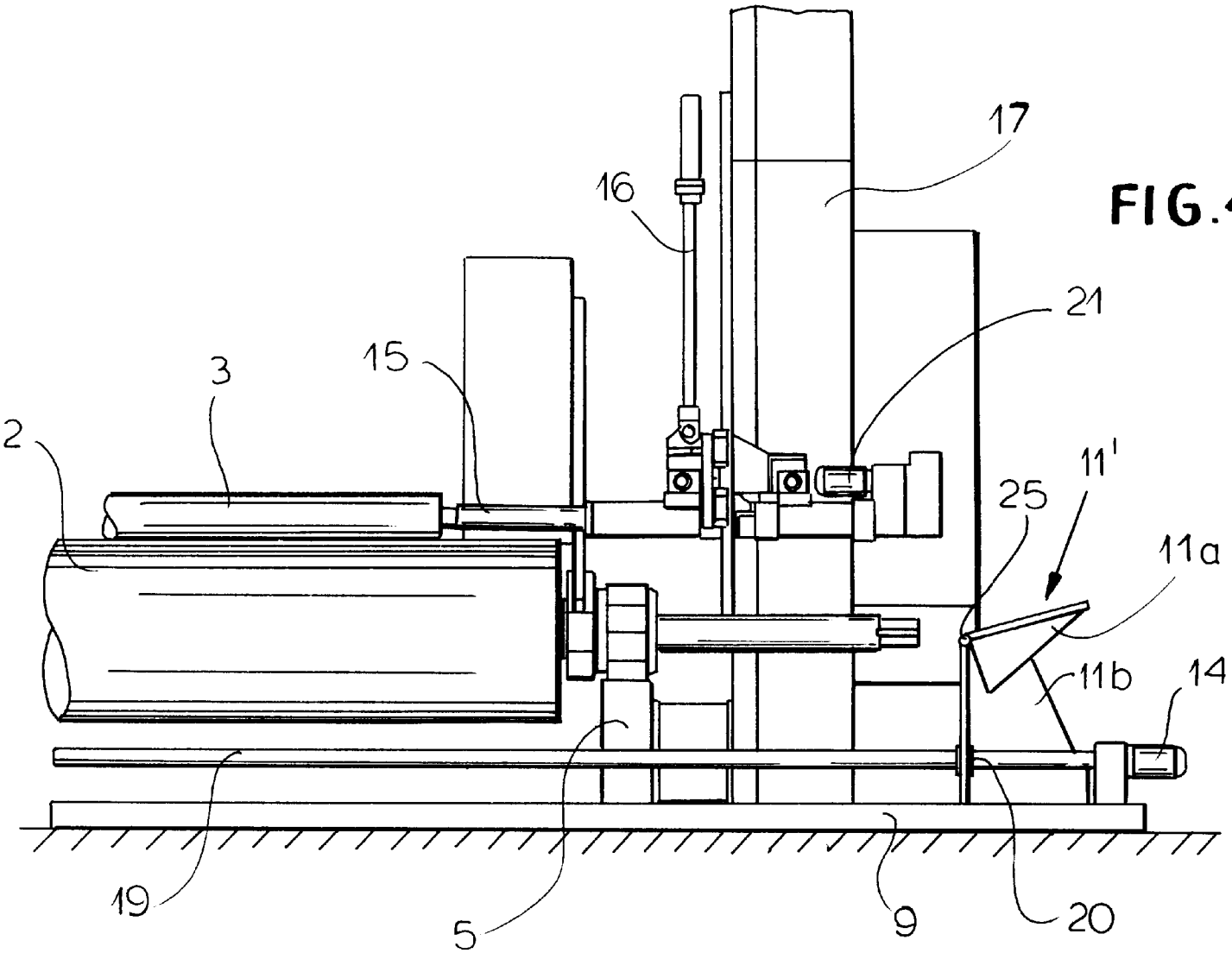
FIG. 4 is a view like FIG. 3 but showing an alternative system in accordance with the invention.

FIG. 2 also shows how a core-loading rod 15 can be moved vertically by an actuator 16 relative to an end stanchion 17 of the frame of the machine and horizontally by another actuator 21 to position a new core in the cradle for forming a new roll 3 or for lifting a full roll 3 off the rollers 1 and 2. As is obvious from FIG. 3 the end shield plate 11 can be backed off so it is completely out of the way of this equipment, allowing the machine to be loaded and unloaded with ease. In fact as shown in FIG. 4 it is possible to use an end plate 11' subdivided level with the axes 1A and 2A by a hinge 25 into an upper part 11*a* and a lower part 11*b*. Swinging back the upper part by an unillustrated actuator further gets this shield 11' out of the way.

With the system of this invention the plates 11 axially close the ends of the space 23 between the rollers 1 and 2 so it can be pressurized from the blower 24 to carry some of the weight of the rolls 3 on the cushion of air created in the space 23. If only one short roll 3 is being made, the plates 11 can be pushed all the way in to embrace it near the center of the machine. Once the rolls are at the desired size, the machine is stopped, the plates 11 retracted, and the equipment 15, 16, 21 is used to remove the full rolls 3 and load in new core sleeves.

I claim:

1. An apparatus for winding a web onto a roll, the apparatus comprising:

a pair of support rollers extending along respective substantially parallel horizontal axes and defining an upwardly open cradle holding the roll;

a bottom plate extending axially underneath the rollers over the lengths thereof;

respective axially extending side plates extending upward from the bottom plate and engaging the rollers, the rollers, rolls, bottom plate, and side plates forming an axially extending and laterally closed space;

a pair of axially spaced end plates lying in respective upright planes, closing ends of the space, each shaped to fit between the rollers and between the side plates, and each slidable axially along the bottom plate between an outer position spaced axially from the rollers and roll and an inner position between the rollers and abut a respective axial end of the roll;

means for pressurizing the space between the end plates; and drive means for displacing the end plates between their positions.

2. The web-winding apparatus defined in claim 1 wherein in their outer positions the end plates are axially offset outward from ends of the rollers.

3. The web-winding apparatus defined in claim 1 wherein the end plates are each formed of a pair of sections and a hinge level with the axes and interconnecting the sections.

4. An apparatus for winding a web onto a roll, the apparatus comprising:

a pair of support rollers extending along respective substantially parallel horizontal axes and defining an upwardly open cradle holding the roll;

a bottom plate extending axially underneath the rollers over the lengths thereof;

respective axially extending side plates extending upward from the bottom plate and engaging the rollers, the rollers, rolls, bottom plate, and side plates forming an axially extending and laterally closed space;

a pair of axially spaced end plates lying in respective upright planes, closing ends of the space, each shaped to fit between the rollers and between the side plates, and each slidable axially along the bottom plate between an outer position spaced axially from the rollers and roll and an inner position between the rollers and abut a respective axial end of the roll;

means for pressurizing the space between the end plates; and drive means for displacing the end plates between their positions, the bottom plate being provided with guides on which the end plates ride.

5. An apparatus for winding a web onto a roll, the apparatus comprising:

a pair of support rollers extending along respective substantially parallel horizontal axes and defining an upwardly open cradle holding the roll;

a bottom plate extending axially underneath the rollers over the lengths thereof;

respective axially extending side plates extending upward from the bottom plate and engaging the rollers, the rollers, rolls, bottom plate, and side plates forming an axially extending and laterally closed space;

a pair of axially spaced end plates lying in respective upright planes, closing ends of the space, each shaped to fit between the rollers and between the side plates, and each slidable axially along the bottom plate between an outer position spaced axially from the rollers and roll and an inner position between the rollers and abut a respective axial end of the roll;

means for pressurizing the space between the end plates; and drive means for displacing the end plates between their positions, the bottom plate having axially extending outer edges provided with hinges carrying the respective side plates.

6. An apparatus for winding a web onto a roll, the apparatus comprising:

a pair of support rollers extending along respective substantially parallel horizontal axes and defining an upwardly open cradle holding the roll;

a bottom plate extending axially underneath the rollers over the lengths thereof;

respective axially extending side plates extending upward from the bottom plate and engaging the rollers, the rollers, rolls, bottom plate, and side plates forming an axially extending and laterally closed space;

a pair of axially spaced end plates lying in respective upright planes, closing ends of the space, each shaped to fit between the rollers and between the side plates, and each slidable axially along the bottom plate between an outer position spaced axially from the rollers and roll and an inner position between the rollers and abut a respective axial end of the roll;

means for pressurizing the space between the end plates; and drive means for displacing the end plates between their positions, the drive means including an axially extending threaded spindle, a motor for rotating the spindle, and a nut on each plate threaded on the spindle.

* * * * *